US009072961B2

(12) United States Patent
Stellenberg et al.

(10) Patent No.: US 9,072,961 B2
(45) Date of Patent: Jul. 7, 2015

(54) PINBALL MACHINE WITH CONTROLLABLE LIGHTING ELEMENTS

(71) Applicant: Multimorphic, Inc., Austin, TX (US)

(72) Inventors: Gerald Stellenberg, Austin, TX (US); Leslie Pitt, Austin, TX (US)

(73) Assignee: MULTIMORPHIC, INC., Austin, TX (US)

( * ) Notice: Subject to any disclaimer, the term of this patent is extended or adjusted under 35 U.S.C. 154(b) by 63 days.

(21) Appl. No.: 13/756,014

(22) Filed: Jan. 31, 2013

(65) Prior Publication Data

US 2013/0181398 A1 Jul. 18, 2013

Related U.S. Application Data

(63) Continuation-in-part of application No. 13/734,151, filed on Jan. 4, 2013.

(60) Provisional application No. 61/632,002, filed on Jan. 17, 2012, provisional application No. 61/632,749, filed on Jan. 31, 2012, provisional application No. 61/633,559, filed on Feb. 14, 2012, provisional application No. 61/633,109, filed on Feb. 6, 2012, provisional application No. 61/685,153, filed on Mar. 13, 2012.

(51) Int. Cl.
*A63F 9/24* (2006.01)
*A63F 7/02* (2006.01)

(52) U.S. Cl.
CPC ..... *A63F 7/027* (2013.01); *A63F 2009/2442* (2013.01); *A63F 2009/2447* (2013.01); *A63F 2009/2451* (2013.01)

(58) Field of Classification Search
CPC ..... A63F 7/02; A63F 2009/2442; A63F 2009/2447; A63F 2009/2451; A63F 7/025; A63F 7/027
USPC ..... 463/3
See application file for complete search history.

(56) References Cited

U.S. PATENT DOCUMENTS 5,449,172 A * 9/1995 Hansen ..... 273/127 R
5,529,294 A * 6/1996 Nordman et al. ..... 273/118 R
6,036,188 A 3/2000 Gomez

OTHER PUBLICATIONS

Pinball News, P3 Pinball Platform, published on Mar. 23, 2012 at http://www.pinballnews.com/learn/p3, last accessed on Dec. 28, 2012.

Pinball News, P3 Update:Team Adds New Game Designer, published on Dec. 5, 2012 at http://www.pinballnews.com/games/p3/index4.html, last accessed on Dec. 28, 2012.

*Primary Examiner* — Steve Rowland
(74) *Attorney, Agent, or Firm* — Luiz von Paumgartten; Fogarty, L.L.C.

(57) ABSTRACT

Pinball machines with controllable lighting components. In some embodiments, a method may include electronically determining a physical property of a ball, the ball configured to move within a playfield of a pinball machine during a pinball game, and modifying a characteristic of a light emitted by a pinball target in response to an evaluation of the physical property. In other embodiments, a pinball machine may be configured to identify a state or mode of a game, and to control a light emitted by a pinball target located within the playfield in response to the state or mode, thus providing a visual indication of the state or mode. In yet other embodiments, a pinball target may include a substrate configured to receive impact from a ball during a game and a light element embedded within the substrate, the light element configurable to emit a light having a controllable property.

20 Claims, 10 Drawing Sheets

PINBALL MACHINE WITH CONTROLLABLE LIGHTING ELEMENTS

CROSS-REFERENCE TO RELATED APPLICATIONS

The present application claims priority to, and is a continuation-in-part (CIP) of, U.S. patent application Ser. No. 13/734,151 filed on Jan. 4, 2013, which claims the priority of U.S. Provisional Patent Application No. 61/632,002 filed on Jan. 17, 2012, of U.S. Provisional Patent Application No. 61/632,749 filed on Jan. 31, 2012, and of U.S. Provisional Patent Application No. 61/633,559 filed on Feb. 14, 2012, the disclosures of which are hereby incorporated by reference herein in their entirety. The present application also claims priority to: U.S. Provisional Patent Application No. 61/632,749 filed on Jan. 31, 2012, U.S. Provisional Patent Application No. 61/633,559 filed on Feb. 14, 2012, U.S. Provisional Patent Application No. 61/633,109 filed on Feb. 6, 2012, and U.S. Provisional Patent Application No. 61/685,153 filed on Mar. 13, 2012, the disclosures of which are hereby further incorporated by reference herein in their entirety.

FIELD

This document relates generally to gaming devices, and more specifically, to pinball machines with controllable lighting components.

BACKGROUND

A pinball machine is an entertainment or amusement device usually found in a variety of public places such as arcades, restaurants, bars, clubs, etc., but sometimes also present in private residences and other environments. Generally speaking, a conventional or traditional pinball machine allows players to play a game in which points are earned by physically manipulating one or more steel balls on a slightly inclined playfield within a glass-covered cabinet.

The pinball machine's playfield typically includes one or more physical targets. When a ball strikes a particular physical target, an electromechanical switch coupled to (or otherwise integrated into) the target detects the mechanical impact, which then triggers a change in some aspect of the game. For example, in some cases, when a ball hits a given target, a player may score a predetermined amount of points.

In most pinball implementations, a "hole" or "drain" is located at the bottom portion of the playfield. Usually, if the ball falls into the drain, the game ends or another ball is provided to the player. Mechanical "flippers" capable of at least partially covering the drain may allow a skilled player to hit the ball at an appropriate time so as to prevent it from falling into the drain, thus putting that same ball back in play and extending the duration of the game.

SUMMARY

Pinball machines with controllable lighting components are described. In an illustrative, non-limiting embodiment, a method may include electronically determining a physical property of a ball, the ball configured to move within a playfield of a pinball machine during a pinball game, and modifying a characteristic of a light emitted by a pinball target within the playfield in response to an evaluation of the physical property.

For example, the pinball target may include at least one of: a trigger or a barrier. The physical property may include at least one of: a position of the ball on the playfield, a speed of the ball over the playfield, or a direction of movement of the ball across the playfield. And the characteristic of the light may include at least one of: color or brightness.

In some implementations, the evaluation of the physical property may include at least one of: a determination that the position of the ball matches a predetermined position on the playfield, a determination that the speed of the ball matches a predetermined speed over the playfield, or a determination that the direction of movement of the ball matches a predetermined direction across the playfield.

Moreover, in some cases, modifying the characteristic of the light may include changing the color or brightness of the light in response to a collision between the ball and the pinball target. For instance, the characteristic of the light may be selected at least in part according to a number of previous collisions between the ball and the pinball target. Additionally or alternatively, modifying the characteristic of the light may include changing the color or brightness of the light in response to the ball being within a preselected distance of the pinball target, the preselected distance being greater than zero. Additionally or alternatively, modifying the characteristic of the light may include changing the color or brightness of the light in response to the ball moving in a predetermined direction relative to the pinball target and independently of whether the ball collides with the pinball target.

In another illustrative, non-limiting embodiment, a pinball machine may include a memory configured to store instructions and processing circuitry operably coupled to the memory, the processing circuitry configured to execute the instructions to cause the pinball machine to identify a state or mode of a game played, at least in part, within a playfield of the pinball machine, and to control a light emitted by a pinball target located within the playfield in response to the state or mode, wherein the light provides a visual indication of the state or mode.

In some applications, the controlled light may instruct a player to hit the pinball target. Additionally or alternatively, the controlled light may indicate a number of times that the pinball target has previously been hit during the game. Additionally or alternatively, the controlled light may indicate a number of times that the pinball target has to be hit during the game in order to enter another state or mode. Additionally or alternatively, the controlled light may instruct a player to avoid hitting the pinball target.

For example, controlling the light may include animating the pinball target with a first sequence of color or brightness settings to indicate a first state or mode or animating the pinball target with a second sequence of color or brightness settings to indicate a second state or mode. Additionally or alternatively, controlling the light may include changing a multi-pixel image rendered by the pinball target.

In yet another illustrative, non-limiting embodiment, a pinball target may include a substrate configured to receive impact from a ball during a game and a light element embedded within the substrate, the light element configurable to emit a light having a controllable property. For example, the property may be selected from the group consisting of: color and brightness, and it may be controllable in response to an identification of a game state or mode. Additionally or alternatively, the property may be controllable in response to an evaluation of a physical property of the ball during the game.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

Systems and methods disclosed herein are directed to pinball machines with controllable lighting components. Generally speaking, some of these systems and methods may be incorporated into, or otherwise combined with, a wide range of other entertainment or amusement devices, including, but not limited to, video games, electro-mechanical games, redemption games, merchandisers, billiards, shuffleboards, table football ("Foosball"), table tennis ("Ping-Pong"), air hockey tables, etc. These systems and methods may also be incorporated into gambling devices, such as slot machines, pachinko machines, or the like. It should be noted, however, that some of the techniques discussed herein may be uniquely applicable to devices that allow a player to manipulate a physical object within a playfield without directly touching that physical object (e.g., pinball machines).

To facilitate explanation of the various systems and methods discussed herein, the following description has been split into sections. In the "Overview" section, examples of a pinball machine and a hybrid playfield are described. The "Hardware" section shows an example of a tracking system, pinball machine hardware, computing system, and controllable lighting components that may be used in certain embodiments. In the "Operations" section, examples of pinball machine software, tracking operations, and light control operations are discussed. It should be noted, however, that the various sections, headings, and subheadings used herein are for organizational purposes only, and are not meant to limit or otherwise modify the scope of the description or the claims.

I. Overview

A. Pinball Machine

Figure 1:
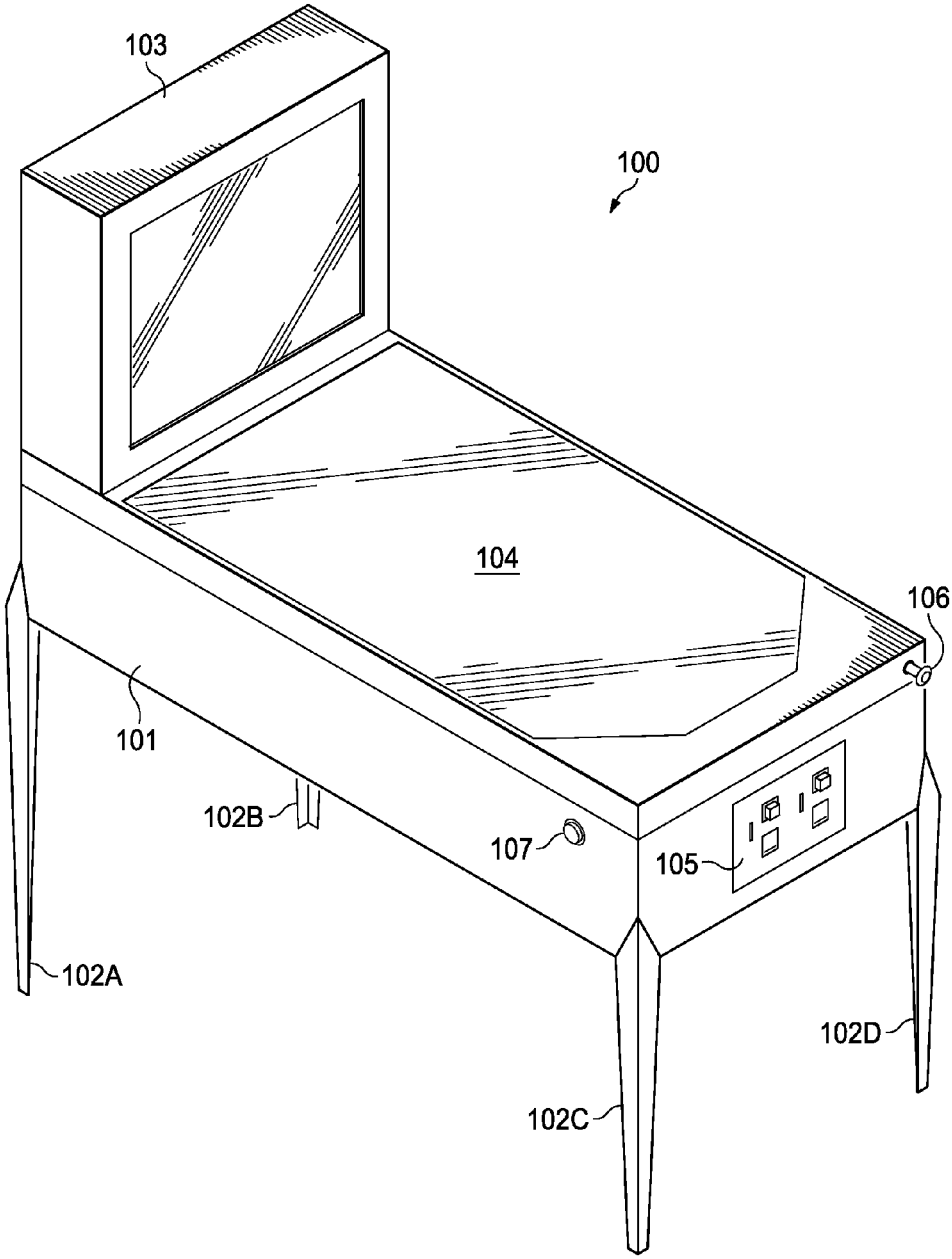
FIG. 1 is a three-dimensional, auxiliary view of an example of a pinball machine according to some embodiments.

Turning to FIG. 1, a three-dimensional, auxiliary view of an example of pinball machine 100 is depicted according to some embodiments. As illustrated, cabinet 101 stands on legs 102A-D, although in other implementations legs 102A-D may be absent and cabinet 101 may sit on a stand, desk, table, countertop, or the like. Cabinet 101 includes hybrid playfield 104, where a game of pinball may take place. Examples of hybrid playfield 104 are discussed in more detail below. In some cases, legs 102A and 102B may be slightly longer than legs 102C and 102D, such that playfield 104 may have an angle of approximately 3.5° to 10.5° with respect to the ground ("pitch"). In other cases, legs 102A-D may each have the same length, and cabinet 101 may be constructed so as to provide a suitable pitch to hybrid playfield 104.

Vertical portion 103 may include one or more electronic displays, video cameras, loudspeakers, etc. Generally speaking, vertical portion 103 may include or otherwise present certain audio-visual information, whether related or unrelated to a pinball game playable on machine 100 (e.g., promotional or marketing materials, etc.).

To enable a player to play a pinball game, front control(s) 105 may allow the user or player to deposit money or tokens into machine 100. As such, front control(s) 105 may include, for example, a credit, coin or token receiver, a magnetic card reader, a Radio Frequency Identification (RFID) scanner, or the like. Front control(s) 105 may also include one or more buttons that allow a user to select a number of players for a particular game, or to simply to start a pinball game. Meanwhile, side control(s) 107 and playfield control(s) 106 allow the user to operate one or more physical objects within hybrid playfield 104. As an example, side control(s) 107 (and/or a corresponding control on the opposite side of cabinet 101, not shown) may include one or more buttons that allow a player to control mechanical "flippers." As another example, playfield control(s) 106 may include one or more buttons or mechanisms that allow the player to control a "plunger" element configured to put a steel ball in play during a pinball game.

Here it should be noted that pinball machine 100 is provided by way of illustration only. In different applications, machine 100 may assume a variety of shapes and forms. Furthermore, one or more components discussed above may be absent or different from what is depicted in FIG. 1. For example, in some cases, front control(s) 105 may be located elsewhere on machine 100, and, in other cases, may include more or fewer elements than shown. For instance, when designed for residential or personal use, machine 100 may not be credit, coin or token-operated. Similarly, side control(s) 107 and/or playfield control(s) 106 may be replaced with motion detection devices (e.g., integrated into vertical portion 103), or may not be necessary for certain games. For example, if steel balls are provided within playfield 104 via an internal mechanism within machine 100, then playfield control(s) 106 may not be necessary.

B. Hybrid Playfield

Figure 2:
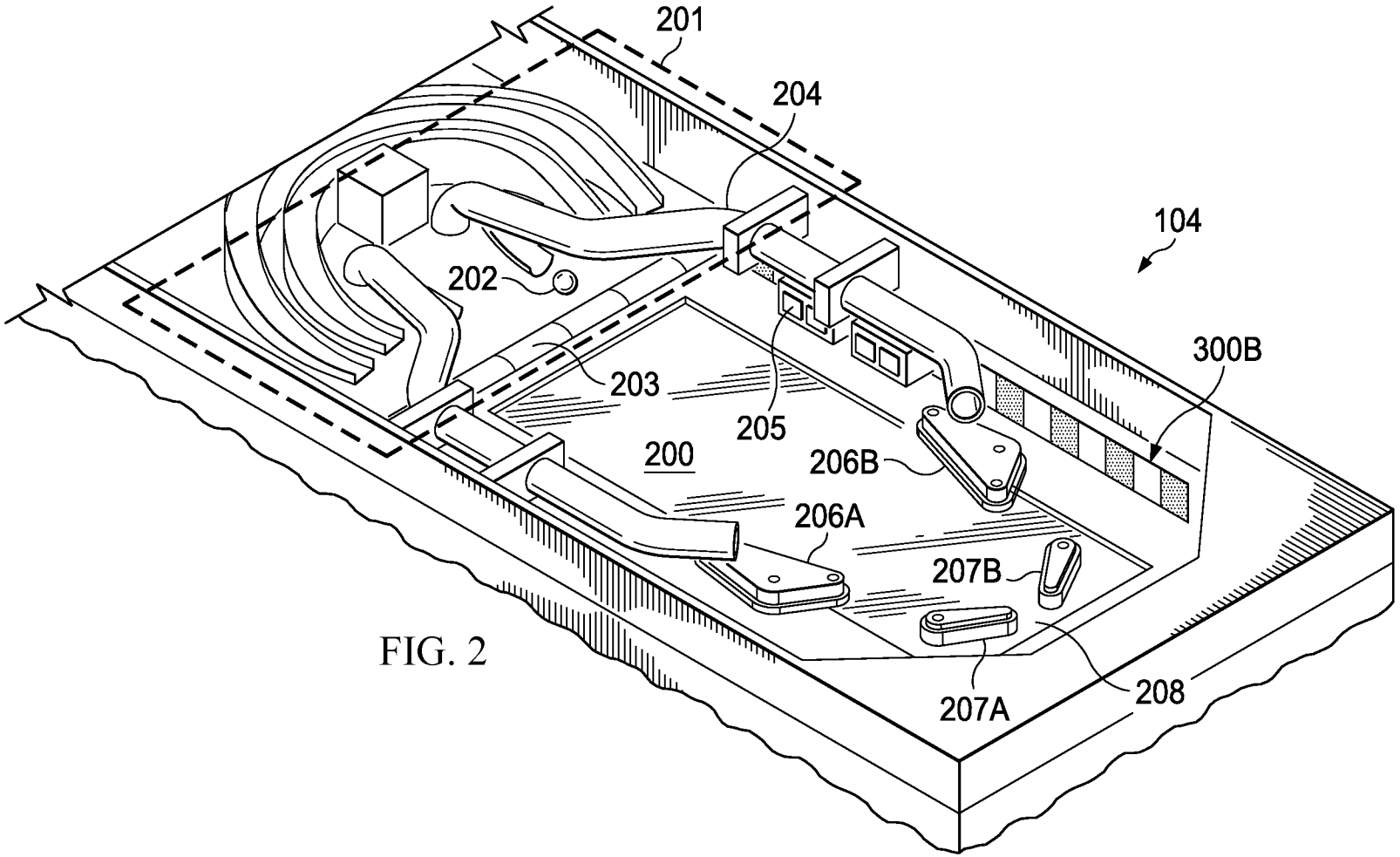
FIG. 2 is a three-dimensional, auxiliary view of an example of a hybrid playfield according to some embodiments.

FIG. 2 is a three-dimensional, auxiliary view of an example of hybrid playfield 104 according to some embodiments. Generally speaking, a "playfield" is a mostly flat surface over which one or more objects, such as ball 202, move in an amusement game, such as a pinball game. Hybrid playfield 104 is a playfield comprising a "physical space" and a "virtual space." The physical space may include one or more mechanical or electromechanical elements, also referred to herein as "physical objects." Electronic display 200 may provide the virtual space portion of hybrid playfield 104 by rendering one or more graphical elements referred to herein as "virtual objects."

In the case of a pinball machine, examples of hybrid playfield 104's physical objects include, but are not limited to, ball(s), plunger(s), bumper(s), kicker(s), bullseye target(s), drop target(s), variable point target(s), roll(s), saucer(s), spinner(s), rollover(s), switch(es), gate(s), stopper(s), ramp(s), toy(s), electromagnet(s), etc. Meanwhile, virtual objects may include any graphical or digital element that may be rendered on electronic display 200, such as, for example, artwork, colors, images, animations, photographs, designs, etc.

In various implementations, systems and methods described herein may allow certain physical objects to cause changes to certain virtual objects and/or vice-versa. Accordingly, these systems and methods may create an impression or an illusion upon a player that physical and virtual elements are interacting during a game, for example, in a physical or mechanical manner.

In the illustrated embodiment, hybrid playfield 104's physical objects include modular portion 201 configured to deploy one or more ball(s) 202 onto the playfield during a game. In this example, modular portion 201 includes barrier element(s) 203 and pipe element(s) 204. Barrier element(s) 203 may include one or more walls that can pop-up and at least partially block ball 202 from transiting between modular portion 201 and other portion(s) of hybrid playfield 104. In some cases, barrier element(s) 203 may act as a "trap" to cause ball 202 to fall under the surface of hybrid playfield 104 or become more or less static for a predetermined amount of time (e.g., by including an electromagnet or the like), for example. Meanwhile, pipe element(s) 204 may allow ball 202 to travel through predetermined paths or "shortcuts" when traveling within hybrid playfield 104.

Once deployed, ball 202 may tend to roll towards drain 208 depending upon the pitch of playfield 104 and absent action by a player operating flippers 207A and/or 207B. Flippers 207A and/or 207B are mechanically or electromechanically-controlled levers used for redirecting ball 202 up playfield 104, preventing ball 202 from falling into drain 208. Through the use of careful, skillful timing, a player may also be to manipulate flippers 207A and/or 207B to intentionally direct ball 202 in a selected direction with a given speed, thus causing ball 202 to hit various types of scoring targets, such as, for example, one or more trigger elements 205 and/or slingshots 206A and 206B.

With respect to hybrid playfield 104's virtual objects, electronic display 200 may be any suitable display or monitor (e.g., a Liquid Crystal Display (LCD) or the like) configured to present graphical designs and/or animations to a player. These virtual objects are configurable depending upon the design of a game, and may interact with certain physical objects in hybrid playfield 104. In some implementations, electronic display 200 may be capable of rendering 2D virtual objects on a flat screen. Additionally or alternatively, electronic display 200 may be capable of producing 3D and/or holographic virtual objects.

Although shown as a single display in FIG. 2, in other embodiments two or more electronic displays 200 may be disposed in playfield 104. For example, in some cases, a first electronic display and a second electronic display may be positioned side-by-side. In other cases, four electronic displays may be arranged such that each occupies a different quadrature of playfield 104. Furthermore, in some cases, electronic display 200 may be at least in part co-extensive with the surface of hybrid playfield 104.

In some embodiments, ball 202 may cause one or more virtual objects rendered by electronic display 200 to appear, disappear, or change depending upon its position on hybrid playfield 104. Similarly, when ball 202 physically interacts with trigger element 205 and slingshots 206A and 206B, for example, one or more virtual objects presented on electronic display 200 may change their behavior in an appropriate manner. Conversely, virtual objects rendered on electronic display 200 may also behave in a way so as to cause a change in one or more of trigger element 205 and slingshots 206A and 206B, for example, thus appearing to a player as if a physical interaction between the virtual object and the physical object has taken place.

Moreover, in some embodiments, one or more of the various physical objects and/or targets described above may each include one or more controllable lighting components, and each controllable lighting component (e.g., trigger element 205 or barrier element 203) may have one or more lighting elements embedded therein. Each lighting element(s) may in turn have one of more of its propert(ies) (e.g., color, brightness, etc.) changed in response to a predetermined event during a pinball game. For example, each lighting element(s) may have its propert(ies) changed depending upon a software-based event, condition, or statement.

Additionally or alternatively, each lighting element(s) may have its propert(ies) changed in response to a collision between ball 202 and the lighting component or target. Additionally or alternatively, each lighting element(s) may have its propert(ies) changed depending upon ball 202's position, speed, or direction when traveling across hybrid playfield 104. Accordingly, in some situations, past, present, and/or future (e.g., expected or intended) collision or proximity between ball 202 and a given target may be indicated in the form of a controllable, varying light that is emitted by the target itself.

II. Hardware

A. Tracking System

In some cases, in order to enable one or more of the foregoing operations, a tracking system may be disposed within machine 100 to determine a position of ball 202 and/or other physical objects. For instance, one or more arrays of infrared (IR) transducers may be disposed immediately above the surface of hybrid playfield 104 along one or more sides of electronic display 200.

Figure 3:
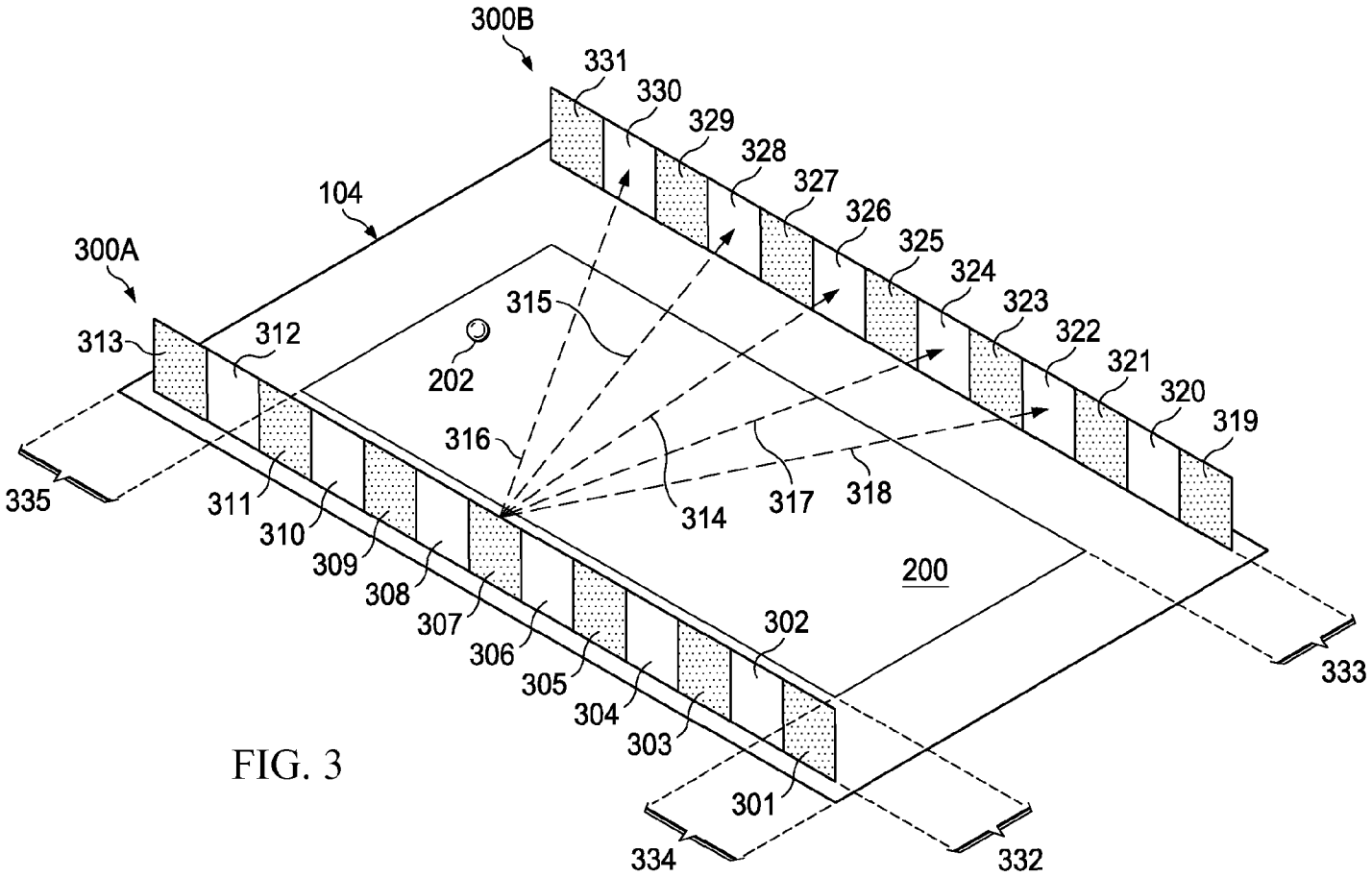
FIG. 3 is a three-dimensional, auxiliary view of an example of a tracking system in a hybrid playfield according to some embodiments.

Turning now to FIG. 3, a three-dimensional, auxiliary view of an example of tracking system 300 in hybrid playfield 104 is depicted according to some embodiments. As illustrated, tracking system 300 includes first IR transducer array 300A and second IR transducer array 300B. Arrays 300A and 300B are disposed immediately above the surface of playfield 104 on opposite sides of electronic display 200, and may be positioned such that other playfield components (e.g., trigger element 205, slingshots 206A and 206B, flippers 207A and 207B, etc.) do not interfere with its operations—that is, so that array 300A may have a least a partial direct line-of-sight with respect to array 300B. For instance, one or more of these playfield components may be "floating" with respect to electronic display 200 (e.g., attached or coupled to the top or cover of hybrid playfield 104).

In this example, arrays 300A and 300B are positioned at distances 332 and 333 from the sides of electronic display 200, and are longer than the height of electronic display 200 by lengths 334 and 335. In some implementations, distances and lengths 332-335 may be selected to avoid interfering with gameplay (i.e., without blocking ball 202's access to modular portion 201 or drain 208). Also, in cases where electronic display 200 extends to the edge of hybrid playfield 104, one or more of distances and lengths 332-335 may be zero and/or transducer arrays 300A and 300B may be positioned outside of hybrid playfield 104.

In this embodiment, IR transducer array 300A includes transmitter elements 301, 303, 305, 307, 309, 311, and 313 alternating with receiver or detector elements 302, 304, 306, 308, 310, and 312. Second IR transducer array 300B includes transmitter elements 319, 321, 323, 325, 327, 329, and 331 alternating with receiver or detector elements 320, 322, 324, 326, 328, and 330. It should be noted, however, that this particular configuration is provided for ease of explanation only, and that many other suitable configurations with a different number of arrays, transmitter elements, and detector elements may be used, sometimes in the same pinball machine 100. For instance, in other embodiments, tracking system 300 may include RF triangulation systems, video based motion tracking systems, capacitive systems, or other electro-mechanical position detection systems.

Figure 14:
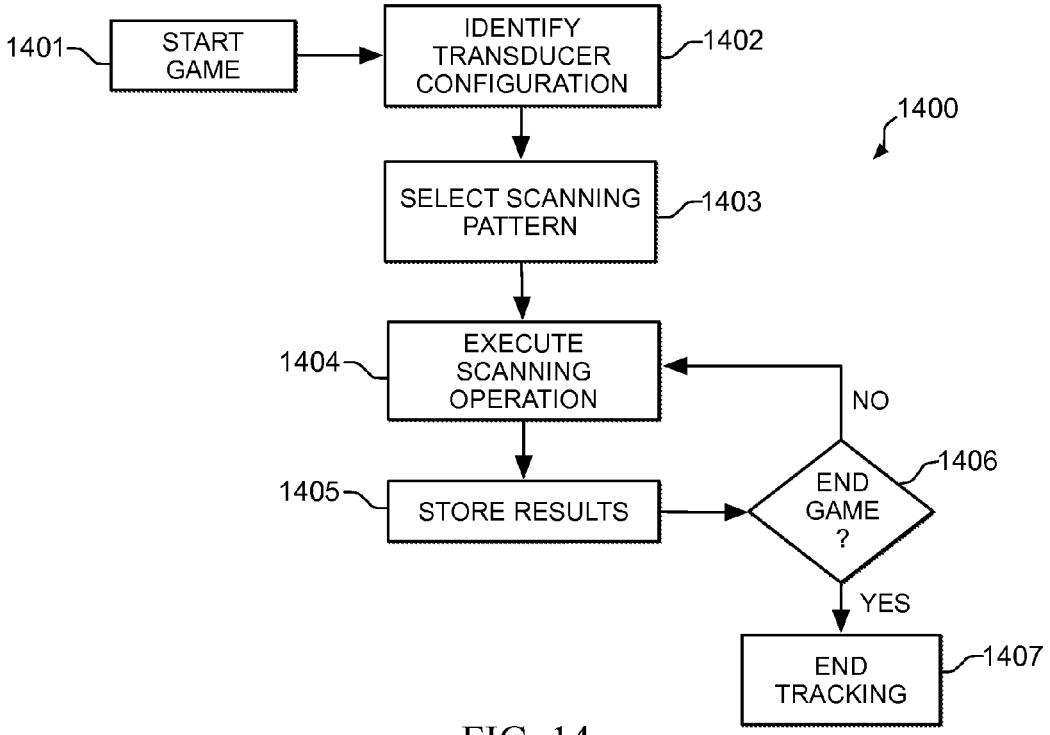
FIG. 14 is a flowchart of an example of a method of operating a tracking system in a hybrid playfield according to some embodiments.
Figure 15:
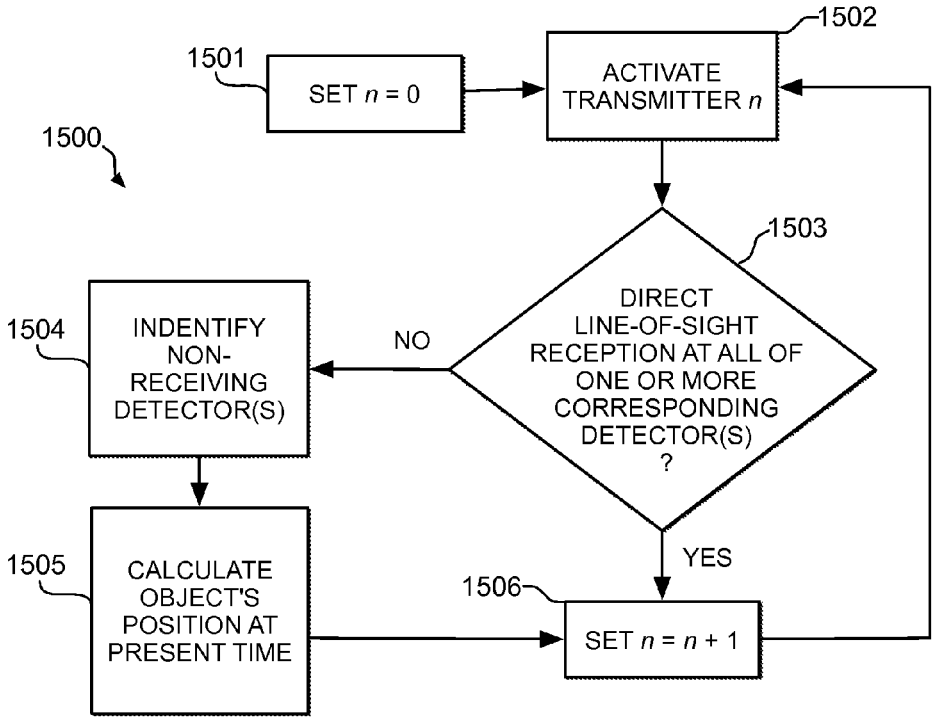
FIG. 15 is a flowchart of an example of a method of obtaining an object's position in a hybrid playfield using a tracking system according to some embodiments.

Tracking system 300 may be configured to scan hybrid playfield 104, for example, as explained in FIGS. 14 and 15. Briefly, each of transmitter elements 301, 303, 305, 307, 309, 311, and 313 of first array 300A may transmit IR signals in succession such that one or more of detector elements 320, 322, 324, 326, 328, and/or 330 of second array 300B receives these signals. Then, each of transmitter elements 319, 321, 323, 325, 327, 329, and 331 of second array 300B may transmit IR signals in succession such that one or more of detector elements 302, 304, 306, 308, 310, and/or 312 of first array 300A receives those signals. By determining which of detector elements 302, 304, 306, 308, 310, 312 320, 322, 324, 326, 328, and/or 330 were expected to receive their respective signals but did not, for example, because ball 202 was blocking that detector's line-of-sight, tracking system 300 may determine the position of ball 202 as it moves across hybrid playfield 104.

In some embodiments, tracking system 300 may be configured to determine the position, speed, and/or direction of movement of a physical object over hybrid playfield 104 with a margin of error no larger than the size of the physical object itself. Tracking system 300 may also be configured to determine the identification of a particular physical object, for example, when two balls 202 occupy hybrid playfield 104 simultaneously (e.g., via a chip or tag included in each ball 202, by maintaining a record of which ball gets deployed at what time and their respective trajectories, etc.). In some implementations, two or more tracking systems 300 may be used in the same hybrid playfield 104, and each of the two or more tracking systems 300 may be of a different type (e.g., an IR system and an RFID system, etc.).

B. Control Hardware

Figure 4:
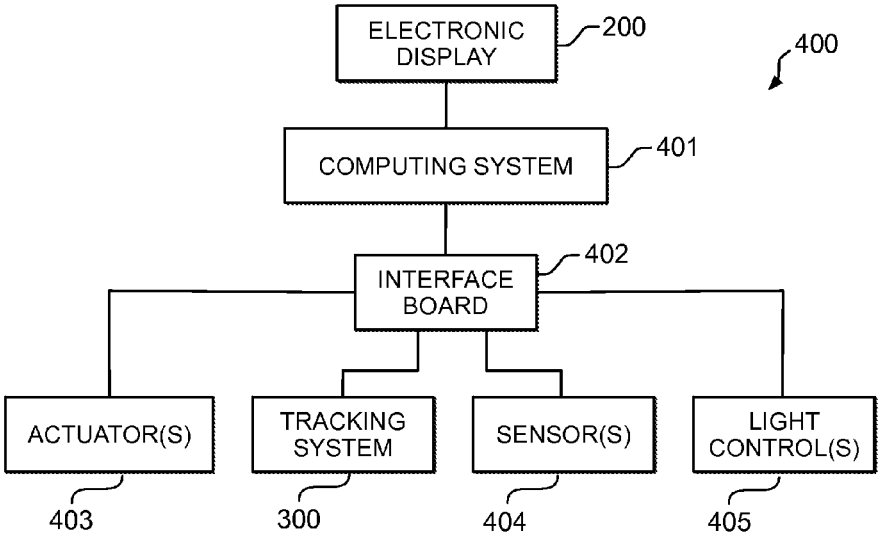
FIG. 4 is a block diagram of an example of hardware elements of a pinball machine with a hybrid playfield according to some embodiments.

FIG. 4 is a block diagram of an example of hardware elements 400 in pinball machine 100 with hybrid playfield 104 according to some embodiments. As shown, computing system or controller 401 is coupled to electronic display 200 of FIG. 2. Computing system 401 is also coupled to (or otherwise includes) interface board 402, which in turn is coupled to tracking system 300, actuator(s) 403, sensor(s) 404, and/or light control(s) 405.

In operation, computing system 401 may be configured to control electronic display 200 by providing one or more video signals capable of being rendered by electronic display 200 to create one or more 2D or 3D virtual objects in hybrid playfield 104 during a pinball game. Also, through interface board 402, computing system 401 may be configured to control the behavior of and/or to receive information related to physical objects in hybrid playfield 104 through interface board 402.

In some embodiments, interface board 402 may be any suitable pinball controller device such as, for example, the "Pinball-Remote Operations Controller" or "P-ROC" controller available from Multimorphic, Inc., which enables a computer to control a pinball machine over Universal Serial Bus (USB). It should be noted, however, that other pinball controller devices may be used as interface board 402, and that such a device may communicate with computing device 401 using any suitable bus and/or communication protocol.

In some cases, interface board 402 may be configured to control actuator(s) 403, such as, for example, coils, motors, etc. to thereby affect the behavior or status of physical elements, such as, for example, ball 202, barrier element 203, pipe element 204, trigger element 205, slingshots 206A and 206B, flippers 207A and 207B, or the like. Interface board 402 may also be configured to receive information from sensor(s) 404 such as, for example, switches, optical sensors, etc., to determine the status of those physical objects. Further, interface board 402 may be configured to control one or more controllable lighting components via light control(s) 405, which in turn may include analog or digital circuitry configured to output signals capable of driving lighting elements. With regard to certain physical objects, such as, for example, ball 202, interface board 402 may also be configured to control tracking system 300 to obtain position and other information about those elements.

C. Computing System

Figure 5:
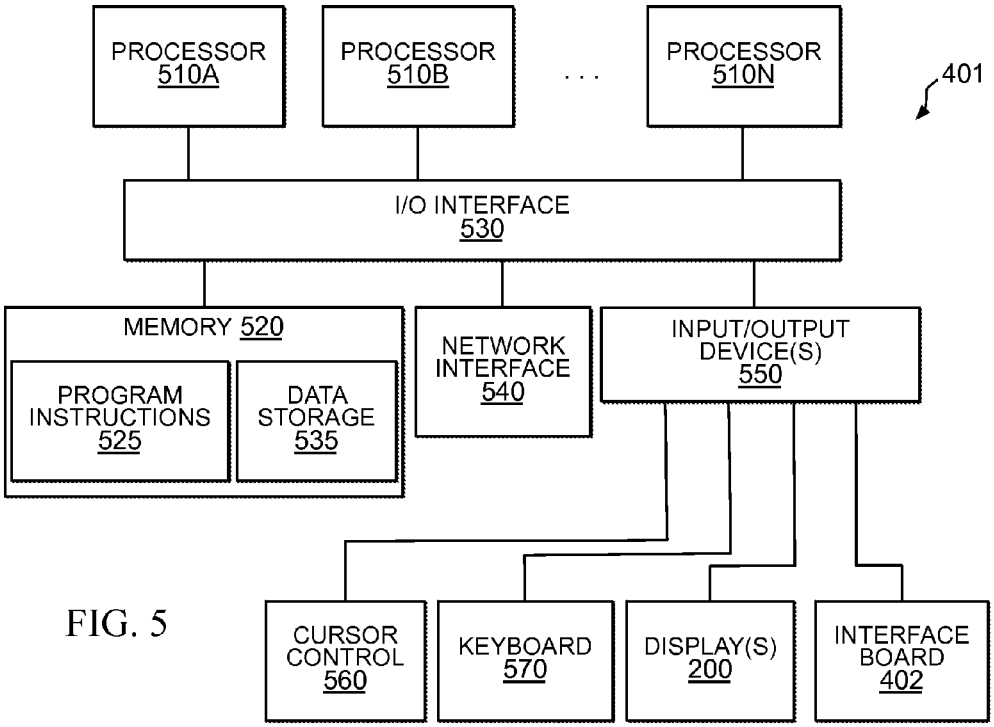
FIG. 5 is a block diagram of an example of a computing system or controller configured to implement aspects of a pinball machine with a hybrid playfield according to some embodiments.

FIG. 5 is a block diagram of an example of computing system 401 configured to implement aspects of pinball machine 100 with a hybrid playfield 104. In some embodiments, computing system 401 may be a server, a mainframe computer system, a workstation, a network computer, a desktop computer, a laptop, or the like. In other embodiments, one or more of the components described in connection with computing system 401 may be provided as a System-On-Chip (SoC), Application Specific Integrated Circuit (ASIC), or the like. More generally, however, computing system 401 may be any system, device, or circuitry capable of implementing or executing one or more of the various operations described herein.

In some implementations, computer system 401 may include one or more processors 510A-N coupled to a system memory 520 via an input/output (I/O) interface 530. Computing system 401 may further include a network interface 540 coupled to I/O interface 530, and one or more input/output devices 550, such as cursor control device 560, keyboard 570, electronic display(s) 200, and interface board 402.

In various embodiments, computing system 401 may be a single-processor system including one processor 510A, or a multi-processor system including two or more processors 510A-N (e.g., two, four, eight, or another suitable number). Processor(s) 510A-N may be any processor capable of executing program instructions. For example, in various embodiments, processor(s) 510A-N may be general-purpose or embedded processors implementing any of a variety of instruction set architectures (ISAs), such as the x86, POWERPC®, ARM®, SPARC®, or MIPS® ISAs, or any other suitable ISA. In multi-processor systems, each of processor(s) 510A-N may commonly, but not necessarily, implement the same ISA. Also, in some embodiments, at least one processor(s) 510A-N may be a graphics processing unit (GPU) or other dedicated graphics-rendering device.

System memory 520 may be configured to store program instructions and/or data accessible by processor(s) 510A-N. In various embodiments, system memory 520 may be implemented using any suitable memory technology, such as static random access memory (SRAM), synchronous dynamic RAM (SDRAM), nonvolatile/Flash-type memory, or any other type of memory. As illustrated, program instructions and data implementing certain operations, such as, for example, those described herein, may be stored within system memory 520 as program instructions 525 and data storage 535, respectively. In other embodiments, program instructions and/or data may be received, sent or stored upon different types of computer-accessible media or on similar media separate from system memory 520 or computing system 401. Generally speaking, a computer-accessible medium may include any tangible, non-transitory storage media or memory media such as magnetic or optical media—e.g., disk or CD/DVD-ROM coupled to computing system 401 via I/O interface 530.

The terms "tangible" and "non-transitory," are intended to describe a computer-readable storage medium (or "memory") excluding propagating electromagnetic signals, but are not intended to otherwise limit the type of physical computer-readable storage device that is encompassed by the phrase computer-readable medium or memory. For instance, the terms "non-transitory computer readable medium" or "tangible memory" are intended to encompass types of storage devices that do not necessarily store information permanently, including for example, random access memory (RAM). Program instructions and data stored on a tangible computer-accessible storage medium in non-transitory form may further be transmitted by transmission media or signals such as electrical, electromagnetic, or digital signals, which may be conveyed via a communication medium such as a network and/or a wireless link.

In an embodiment, I/O interface 530 may be configured to coordinate I/O traffic between processor 510, system memory 520, and any peripheral devices in the device, including network interface 540 or other peripheral interfaces, such as input/output devices 550. In some embodiments, I/O interface 530 may perform any necessary protocol, timing or other data transformations to convert data signals from one component (e.g., system memory 520) into a format suitable for use by another component (e.g., processor(s) 510A-N). In some embodiments, I/O interface 530 may include support for devices attached through various types of peripheral buses, such as a variant of the Peripheral Component Interconnect (PCI) bus standard or the Universal Serial Bus (USB) standard, for example. In some embodiments, the function of I/O interface 530 may be split into two or more separate components, such as a north bridge and a south bridge, for example. In addition, in some embodiments some or all of the functionality of I/O interface 530, such as an interface to system memory 520, may be incorporated directly into processor(s) 510A-N.

Network interface 540 may be configured to allow data to be exchanged between computing system 401 and other devices attached to network 115, such as other computer systems, or between nodes of computing system 401. In various embodiments, network interface 540 may support communication via wired or wireless general data networks, such as any suitable type of Ethernet network, for example; via telecommunications/telephony networks such as analog voice networks or digital fiber communications networks; via storage area networks such as Fiber Channel SANs, or via any other suitable type of network and/or protocol.

Input/output devices 550 may, in some embodiments, include one or more display terminals, keyboards, keypads, touch screens, scanning devices, voice or optical recognition devices, or any other devices suitable for entering or retrieving data by one or more computing system 401. Multiple input/output devices 550 may be present in computing system 401 or may be distributed on various nodes of computing system 401. In some embodiments, similar input/output devices may be separate from computing system 401 and may interact with one or more nodes of computing system 401 through a wired or wireless connection, such as over network interface 540.

As shown in FIG. 5, memory 520 may include program instructions 525, configured to implement certain embodiments described herein, and data storage 535, comprising various data accessible by program instructions 525. In an embodiment, program instructions 525 may include software elements of embodiments illustrated in FIG. 2. For example, program instructions 525 may be implemented in various embodiments using any desired programming language, scripting language, or combination of programming languages and/or scripting languages (e.g., C, C++, C#, JAVA®, JAVASCRIPT®, PERL®, etc.). Data storage 535 may include data that may be used in these embodiments. In other embodiments, other or different software elements and data may be included.

A person of ordinary skill in the art will appreciate that computing system 401 is merely illustrative and is not intended to limit the scope of the disclosure described herein. In particular, the computer system and devices may include any combination of hardware or software that can perform the indicated operations. In addition, the operations performed by the illustrated components may, in some embodiments, be performed by fewer components or distributed across additional components. Similarly, in other embodiments, the operations of some of the illustrated components may not be performed and/or other additional operations may be available. Accordingly, systems and methods described herein may be implemented or executed with other configurations.

D. Controllable Lighting Components

In various embodiments, pinball machine 100 may contain controllable lighting components that serve various purposes. For example, certain controllable lighting components may be used to illuminate areas of hybrid playfield 104 or other objects to make them easier to see. Additionally or alternatively, controllable lighting components may be used to identify game state and mode information. Additionally or alternatively, controllable lighting components may be used to identify shots or targets that need to be hit during progress of the game. Additionally or alternatively, controllable lighting components may be used as to provide animated visual effects such as flashing brightly in various sequences.

Each controllable lighting component may include either incandescent light bulbs or light emitting diodes (LEDs) as illuminating element(s). Traditionally, lighting elements have been either exposed (directly visible to an onlooker) or covered by an object such as a hollow dome or piece of plastic or other translucent or transparent material. In contrast, in some embodiments described herein, a controllable lighting component may have a substrate configured to receive the impact of ball 202 during a pinball game, and/or a light element that is embedded within the substrate.

In some cases, the substrate may be an object that was not originally made to contain or cover the lighting element. More specifically, the object may be modified from its original form so that a lighting element can be placed inside of it. When the lighting element is activated so that it emits light, the light is transferred to the object, thereby creating an illusion that the object, either the entirety of it or only one or more parts of it, is emitting light. In some situations, the process of modifying the object to contain one or more lighting elements may also include modifying its shape to serve aesthetic purposes or other reasons. In other words, modifications made to the object need not be restricted to only those performed for the purpose of embedding a lighting element.

Examples of objects that may be modified to contain a lighting element, thereby enabling the combination of the objects and the lighting elements to create embedded lighting, may include glass, acrylic, LEXAN, plastic, or any other object or material that can be modified to contain a lighting element. In some cases, a substrate may be chosen because it has properties that help to either disperse or focus light traveling through them.

Figure 6:
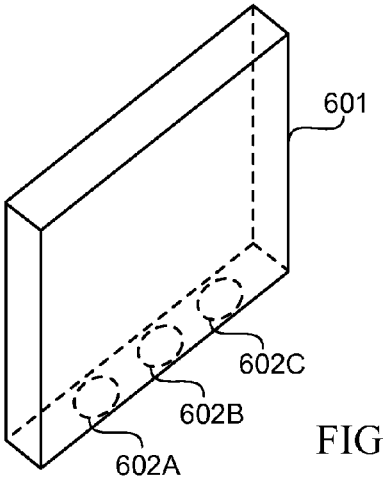
FIG. 6 is a three-dimensional, auxiliary view of an example of a substrate of a controllable lighting component according to some embodiments.

FIG. 6 is a three-dimensional, auxiliary view of an example of a substrate 601 of a controllable lighting component configured to receive three lighting elements. In some embodiments, substrate 601 may be used as a target or other physical object within hybrid playfield 104, such as, for example, part of barrier element 203, trigger element 205, slingshots 206A and 206B, flippers 207A and 207B, etc. Generally speaking, substrate 601 may have any suitable shape or form, and it may be modified to include one or more holes or cavities 602A-C, each cavity configured to receive a lighting element (e.g., a light bulb, an LED, etc.). It should be noted that, although three cavities 602A-C are shown in this example, other implementations may use fewer or more cavities depending upon how many different lighting elements are being used (one or more), how many different colors will be displayed, how much playfield space is available, etc.

In this example, substrate 601 may be an acrylic block. When one or more lighting elements are inserted into cavities 602A-C, light emitted by those elements is transferred into substrate 601, thus causing an illusion or visual impression that substrate 601 is itself lit up. In other words, in some embodiments, the entirety of the resulting lighting component (substrate 601 plus one or more lighting elements) may appear to be lit as a monolithic element cast as a single piece. This is in contrast with, for example, a situation where a lighting element is merely disposed near or under an object. In the latter case, although some visible light may transfer into or reflect off of the object, that object does not appear to emit nearly as much light as it would if the light element were embedded inside of it.

Another distinction between a controllable lighting component using substrate 601 versus a plastic dome or covered light is that, in some cases, substrate 601 may not have been created for the purpose of containing a lighting element. Rather, substrate 601 may have been created for traditional uses of acrylic blocks or the like, and then modified so that a lighting element may be embedded in it, and so that substrate 601 itself appears to be emitting light.

Although substrate 601 is illustrated as having the shape of a box or block, it should be noted that, in other embodiments, substrate 601 may have any suitable shape. For example, substrate 601 may have a circular or star shape, the shape of a number, letter or symbol, the shape of a game character or other entity, etc. Furthermore, although cavities 602A-C are shown at the bottom portion of substrate 601, it should be understood that, in other embodiments, one or more (or all) of cavities 602A-C may be placed in other portions of substrate 601 (e.g., a top or lateral portion of substrate 601).

In alternative embodiments, lighting elements and substrates may be combined in many different ways to create embedded lighting components, which may then be controlled in a pinball machine as described in detail below. In some cases, a lighting element may be placed inside of a hole drilled into the substrate. Another example is where the substrate is of a flexible, rubbery material that deforms to allow a lighting element to be inserted in it. In yet another example, a slit may be cut into the substrate to allow the insertion of a lighting element.

Figure 7:
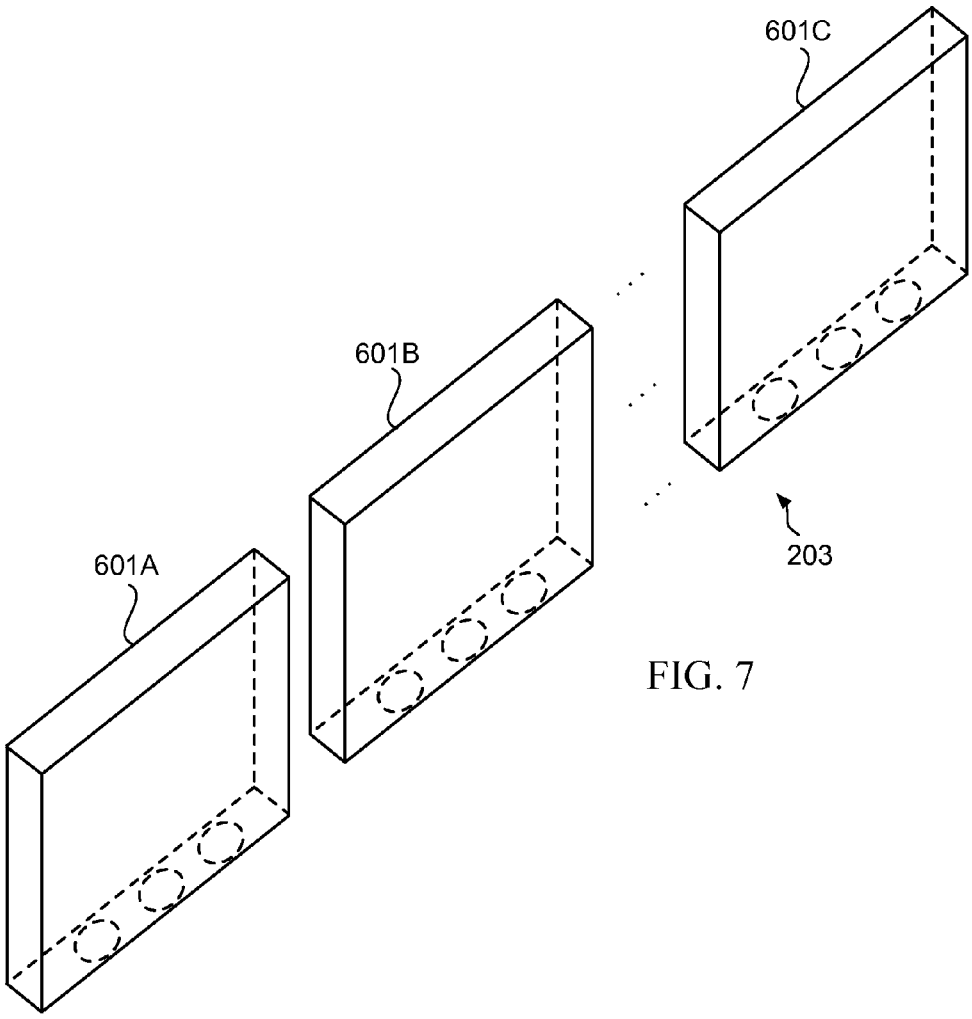
FIG. 7 is a three-dimensional, auxiliary view of an example of an array of substrates assembled as a barrier according to some embodiments.

FIG. 7 is a three-dimensional, auxiliary view of an example of an array of substrates 601A-C arranged to form barrier 203, originally shown in FIG. 2. In some implementations, each of substrates 601A-C may have its own cavity or cavities, and each cavity may be configured to receive one or more lighting elements. As previously described, in some cases, each individual substrate may be mechanically raised or lowered during a game, and, when assembled to form a controllable lighting component, each component may be controlled to provide certain visual information to a player during the game.

Figure 8:
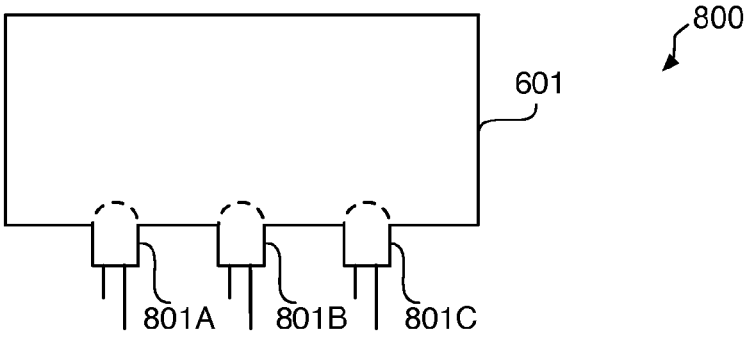
FIG. 8 is a diagram of an example of a controllable lighting component with three discrete lighting elements according to some embodiments.

FIG. 8 is a diagram of an example of controllable lighting component 800 with three discrete lighting elements 801A-C according to some embodiments. Particularly, component 800 may include substrate 601 of FIG. 6 with lighting elements 801A-C inserted into respective ones of cavities 602A-C. For example, each of lighting elements 801A-C may be a light emitting diodes (LED) having a red, blue, or green (RGB) color. Depending upon how each LED is activated (e.g., what amount of voltage or current is applied to its terminals, at what frequency, etc.), component 800 may appear to emit a large variety of colors. In other examples, each of lighting elements 801A-C may have a same color, thereby making component 800 appear more or less bright depending upon how many of lighting elements 801A-C are activated at a given time.

Figure 9:
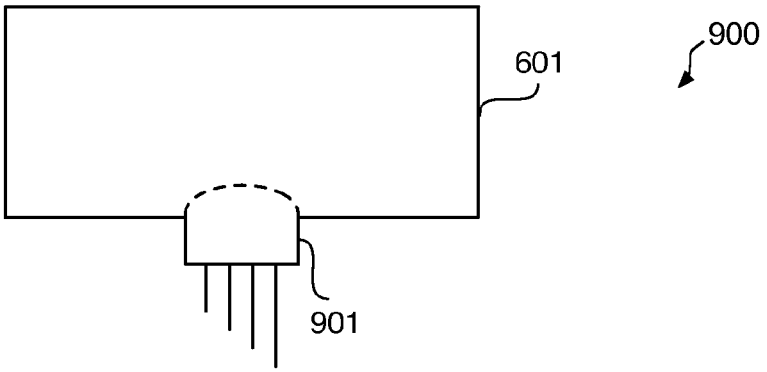
FIG. 9 is a diagram of an example of a controllable lighting component with a single, multicolor lighting element according to some embodiments.

Although described herein in terms of "colors," it should be noted that, in certain embodiments, any given one of lighting elements 801A-C may emit electromagnetic radiation in the non-visible spectrum. For example, a given lighting element may include an ultraviolet bulb capable of emitting black light or UV-A light, configured to interact with fluorescing elements (e.g., slingshots, flippers, etc.) within hybrid playfield 104. It should be further noted that, in some cases, a controllable lighting component is not restricted to having single-color lighting elements. In that regard, FIG. 9 is a diagram of an example of controllable lighting component 900 with multicolor lighting element 901, according to some embodiments.

Figure 10:
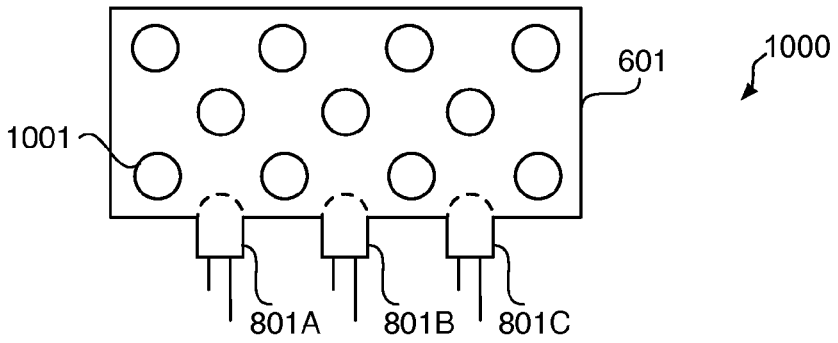
FIG. 10 is a diagram of an example of a controllable lighting component with diffuser features according to some embodiments.

FIG. 10 is a diagram of an example of controllable lighting component 1000 with diffuser features 1001 according to some embodiments. In this example, diffuser features 1001 have a spherical or semi-spherical shape with a diameter equal or approximately equal to that of cavities 602A-C; although other shapes may be used depending upon the desired visual effect of component 1000. In operation, diffuser features 1001 may help distribute the light emitted by lighting components 801A-C throughout the interior of substrate 601, thus further creating the impression that the entire component 1000 is lit.

Generally speaking, diffuser features 1001 may be drilled or otherwise built into substrate 601. For instance, in a case where an acrylic block or plastic is used, diffuser features 1001 may be formed as bubbles within substrate 601. Additionally or alternatively, diffuser features 1001 may be carved on the outer surfaces of substrate 601.

Figure 11:
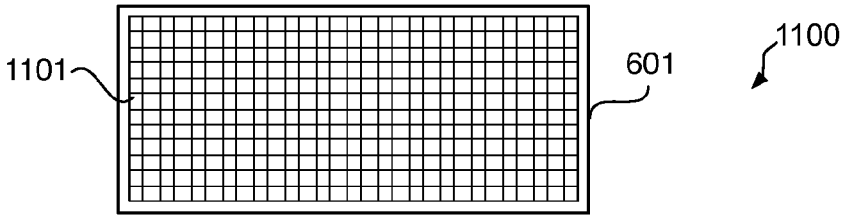
FIG. 11 is a diagram of an example of a controllable lighting component with an LCD display or matrix according to some embodiments.

In some cases, rather than using discrete lighting elements, a controlled lighting component may include an LCD display or other rendering device. For example, FIG. 11 is a diagram of controllable lighting component 1100 with LCD display or matrix 1101. In some embodiments, LCD display 1101 may be embedded into substrate 601, for instance, through a slit cut across one or more surfaces of substrate 601. In operation, LCD display or matrix 1101 may be configured to convey different colors, images or text to an onlooker during a pinball game.

Figure 12:
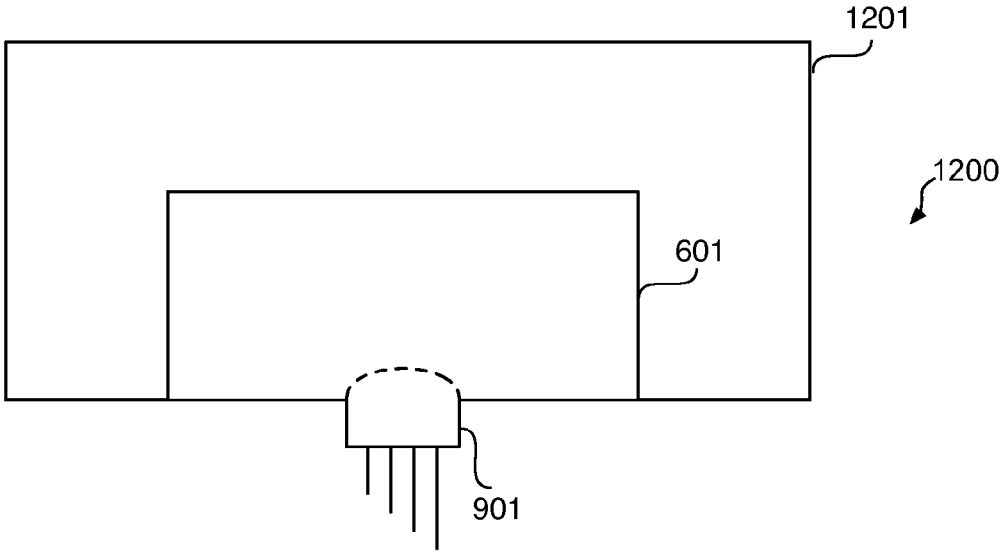
FIG. 12 is a diagram of an example of a multi-layered, controllable lighting component according to some embodiments.

In other cases, an embedded lighting element may be further inserted into another object, thereby creating larger embedded lighting element. FIG. 12 is a diagram of an example of a multi-layered, controllable lighting component 1200 according to some embodiments. Here, substrate 1201 of component 1200 is adapted to receive another substrate 601, which in turn is configured to receive one or more lighting elements 901. In this case, the entire component 1201 may appear as if it were lit. This process may be repeated any suitable number of times to create complex lighting components, including ones where different substrates have different shapes and sizes. For example, a first substrate having a first geometric shape and size may be embedded into a second substrate of a second geometric shape and size, which may then be embedded into a third substrate of a third geometric shape and size.

It should be noted that the examples of FIGS. 6-12 show controllable lighting components that may be used as, or otherwise included within, physical objects of hybrid playfield 104. In other words, in some cases, these various controllable lighting components may be actual targets, walls, or other elements of pinball machine 100 that physically interact or collide with ball 202 during a pinball game.

III. Operations

A. Pinball Software

Figure 13:
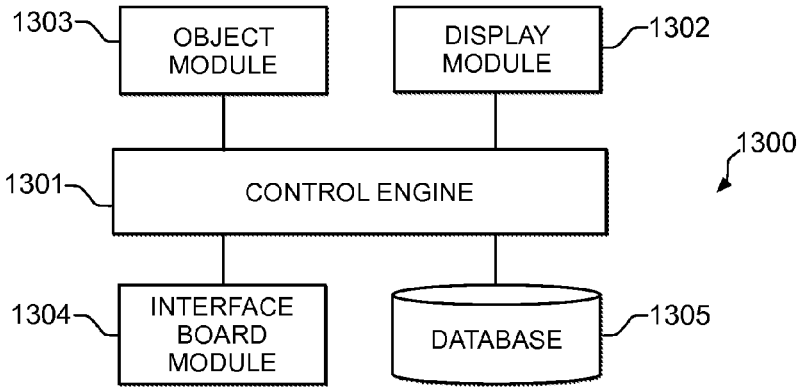
FIG. 13 is a block diagram of an example software program configured to implement aspects of a pinball machine with a hybrid playfield according to some embodiments.

FIG. 13 is a block diagram of an example software program 1300 configured to implement aspects of pinball machine 100 with a hybrid playfield 104. In some embodiments software 1300 may be executed by computing system 401 described above. For example, in some cases, software program 1300 may be implemented as program instructions 525 of FIG. 5. Generally speaking, control engine 1301 may include one or more routines configured to implement one or more of the various techniques described herein. For instance, control engine 1301 may include one or more routines configured to allow a user to select a game stored in database 1305. Control engine 1301 may also include one or more routines configured to allow a user to start or terminate a game, as well as one or more routines configured to manage progress of a game.

Display module 1302 may provide a software interface between computing device 401 and electronic display 200 such that images produced by display module 1302 are rendered in electronic display 200 under control of control engine 401. Interface board module 1304 may provide a software interface between computing device 401 and interface board 402. Through interface board module 402, control engine 401 may determine that one or more sensor(s) 404 have been activated and/or it may control, via actuator(s) 403, a physical aspect of a physical object in hybrid playfield 104. Control engine 401 may also receive tracking information from tracking system 300 via interface board module 402.

Object module 1303 may keep track of one or more graphical elements or virtual objects being displayed (or yet to be displayed) on electronic display 200 via display module 1302, including, for example, a virtual object's characteristics such as the object's identification, boundaries, shape, color, size, texture, position (on electronic display 200), speed, direction of movement, etc. Object module 1303 may also keep a record of the received tracking information for one or more physical objects including, for example, an identification of the physical object, its position (above electronic display 200), speed, direction of movement, shape, etc.

In some embodiments, the modules or blocks shown in FIG. 13 may represent processing circuitry and/or sets of software routines, logic functions, and/or data structures that, when executed by the processing circuitry, perform specified operations. Although these modules are shown as distinct logical blocks, in other embodiments at least some of the operations performed by these modules may be combined in to fewer blocks. For example, in some cases, object module 1303 may be combined with display module 1302 and/or with interface board module 1304. Conversely, any given one of modules 1301-1305 may be implemented such that its operations are divided among two or more logical blocks. Although shown with a particular configuration, in other embodiments these various modules or blocks may be rearranged in other suitable ways.

B. Tracking Operations

FIG. 14 is a flowchart of an example of method 1400 of operating tracking system 300 in hybrid playfield 104. In some embodiments, method 1400 may be performed, at least in part, by computing system 401 executing software 600 in cooperation with interface board 402 and tracking system 300. At block 1401, method 1400 may include determining that a pinball game has started or is about to start. At block 1402, method 1400 may include identifying a transducer configuration to be used by tracking system 300. As previously noted, different transducer configurations may be used in a single machine 100, and, depending upon the specific game being played, a particular configuration may be more suitable for tracking certain physical objects.

At block 1403, method 1400 may include selecting a scanning pattern to be used during a tracking operation. For example, in the configuration shown in FIG. 3, the selected scanning pattern assigns detector elements 322, 324, 326, 328, and 330 to receive signals 318, 317, 314, 315, and 316 emitted by transmitter element 307, respectively. In some cases, a scanning pattern may be such that each of transmitter elements 301, 303, 305, 307, 309, 311, 313, 319, 321, 323, 325, 327, 329, and 331 is activated in rapid succession and in this order. In other cases, a transmitter element of first transducer array 300A may be activated followed by a transmitter element of second transducer array 300B in an alternating manner (e.g., 301, 319, 303, 321, and so on). In yet other cases, two or more transmitter elements may be activated simultaneously.

In some implementations, more or fewer detectors may be assigned to receive more or fewer signals from a given transmitter element at a given time. Moreover, the position of the transmitter element may dictate how many and which detector elements are assigned for a given scanning pattern. For instance, using the pattern illustrated in FIG. 3, when transmitter 301 is active, only detectors 320 and 322 (i.e., two detectors) may be configured to receive its signals. When transmitter 303 is active, detectors 320, 322, 324, and 326

(i.e., four detectors) may be configured to receive its signals. And, when transmitter 305 is active, detectors 320, 322, 324, 326, and 328 (i.e., five detectors) may be configured to receive its signals. In other implementations, however, a 1:1 relationship between transducer elements may be established such that a given detector is assigned to a single corresponding transmitter and vice-versa.

More generally, any suitable scanning pattern may be selected that creates a mesh such that, when a physical object such as ball 202 is traveling between transducer arrays 300A and 300B therefore blocking the line-of-sight between a transmitter and an assigned detector, tracking system 300 and/or computing system 401 is capable of determining the position, speed, and/or direction of movement of the physical object. In various embodiments, signals are transmitted and received between transducer arrays 300A and 300B at angles other than a right angle.

At block 1404, method 1400 may execute scanning operation(s) using the identified configuration and/or selected pattern and, at block 1405, method 1400 may store results of those operation(s). At block 1406, method 1400 may determine whether the game has ended. If not, control returns to block 1404. Otherwise, tracking may end at block 1407.

It should be noted that, in some embodiments, one or more of the operations described above may be conducted independently of whether a game is in progress. For example, in some cases, tracking may be active for purposes of touchscreen interactions when pinball machine 100 is in "service mode" (e.g., testing, debugging, etc.). More generally, electronic display 200 in conjunction with tracking system 300 may allow an operator to interface with aspects of computing system 401 at any time, for instance, to change the machine's configuration, select a new pinball game, test one or more of the machine's components, etc.

FIG. 15 is a flowchart of an example of method 1500 of obtaining an object's position in hybrid playfield 104 using tracking system 300 according to some embodiments. Again, in some embodiments, method 1500 may be performed, at least in part, by computing system 401 executing software 600 in cooperation with interface board 402 and tracking system 300. At block 1501, method 1500 may include initializing or setting an integer or counter n to a zero value and, at block 1502, method 1500 may include activating transmitter element n.

At block 1503, method 1500 may include determining whether there is a direct line-of-sight reception at all of the one or more assigned detector elements. If so, then block 1506 increments the value of n and control returns to block 1502, where a subsequent transmitter element following the selected scanning pattern is selected. Otherwise, at block 1504, method 1500 may include identifying which of the assigned detector elements had its light-of-sight blocked by a physical object. Then, at block 1505, method 1500 may include calculating the physical object's position based, at least in part, upon the result of block 1504.

To illustrate operations 1502-1506, consider the following example. Assume, hypothetically, that ball 202 shown in FIG. 3 is now at a position such that it blocks the light-of-sight of detector 330 when transmitter 307 is activated. Because the relative position between arrays 300A and 300B is known, it may be inferred that, at the time of the scan, ball 202 was located somewhere along the path of signal 316. As n is incremented, subsequent transmitter elements are activated and other detectors may have their light-of-sight blocked, such that the position of ball 202 may be determined to be at the intersection(s) of two or more of these signals.

In some embodiments, the frequency of the scanning operation may be such that a sufficient number of transmitters are activated in series to resolve the position of ball 202 prior to ball 202 having moved to another position that is significantly distant from the resolved position. For example, in some cases, the position of ball 202 may be identified with a margin of error no larger than the diameter of ball 202.

Computing system 401, interface board 402, and/or object module 403 may also maintain a historical record of the positions of ball 202 at different times. Therefore, computing system 401 and/or interface board 402 may be configured to calculate a speed of ball 202 and/or a direction of movement of ball 202 based on that historical record. In some cases, computing system 401 and/or interface board 402 may be further configured to predict the position of ball 202 at a future time based upon its present and/or past behavior.

C. Light Control Operations

In some embodiments, a controllable lighting component such as described in FIGS. 6-12 may be used to visually convey information during a pinball game. Particularly, a controllable lighting component may operate under command of light controller 405 receiving instructions from computing system 401 (both shown in FIG. 4), which in turn executes software 1300 (of FIG. 13). Software 1300 may issue instructions that cause a controllable lighting component to change the wavelength and/or intensity of its light emissions. A few examples of different types of information that may be conveyed by a controllable lighting component are discussed below.

In some implementations, a controllable lighting component may be used as a pinball target (e.g., trigger 205 or barrier 203) within hybrid playfield 104. In some cases, ball 202 may be intended to collide with such a target during normal progress of the game. As previously noted, the shape, material, etc. that affect the way a controllable lighting component's look and feel can vary, as can the method used to detect when ball 202 collides with or is in close proximity to the controllable lighting component.

For example, a detection mechanism configured to determine when a ball collides with or is in very close proximity to the object does not necessarily have to be physically attached to the object. In some cases, the detection mechanism may be a switch located on or near the target such that an electrical path is created or broken when ball 202 hits or rolls close by the controllable lighting component. In other cases, the detection mechanism may be an infrared tracking system such as described in FIG. 3. In yet other case, the detection mechanism may be a system having a video camera or sensor and video processing logic configured to determine when 202 ball contacts the controllable lighting component. Other suitable detection mechanism may also be used.

In various embodiments, by controlling the color and or brightness of the lighting element(s) within a controllable light component, various and unlimited forms of information can be portrayed to an onlooker, such as the person playing the pinball machine.

Figure 16:
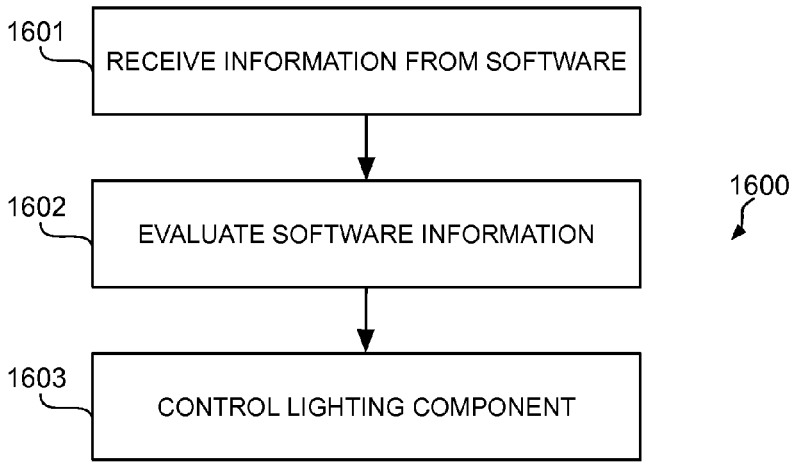
FIG. 16 is a flowchart of an example of a method of operating a lighting component in a pinball machine based on software events or information according to some embodiments.

FIG. 16 is a flowchart of an example of a method of operating a lighting component in a pinball machine based on software events or information. In some embodiments, method 1500 may be performed, at least in part, by computing system 401 executing software 1300 in cooperation with interface board 402 and light control(s) 405. At block 1601, method 1600 may include receiving information from software. For example, the information may be related to a game state, game mode, or a goal to be achieved by the player.

Examples of game state may include, but are not limited to, an ongoing game, an idle game, an interval between different stages or goals, a game stage or round, a bonus stage or round, etc. Examples of game modes may include, but are not limited to, beginner, intermediate, expert, survival, multiplayer, etc. Examples of goals to be achieved by the player may include, but are not limited to, reaching or avoiding a portion of the playfield, hitting or avoiding a particular target, etc.

At block 1602, method 1600 may include evaluating the software information to identify and/or determine how to control a particular controllable lighting component in response to the received information. Then, at block 1603, method 1600 includes actually controlling the lighting component to visually convey the information to the player.

To illustrate method 1600, consider the following examples, where a controllable lighting component may be used as a target. In one implementation, the target may emit a first color (e.g., green) to suggest that the player should try to hit the target, or it may emit a second color (e.g., red) to suggest that the player should avoid hitting the target. Light colors may also be changed over time to provide additional information to the onlooker. In another implementation, lighting changes may be animated. For instance, the color of a target may be changed progressively such that it smoothly fades from one color to another, to indicate that no specific game state is currently active (i.e., the machine is idle). Conversely, the color of may fade between a different set of colors to indicate a corresponding game mode is active. In general the foregoing examples may involve software conditions or statements that are independent of physical interactions taking place between the target and ball 202, for instance.

Figure 17:
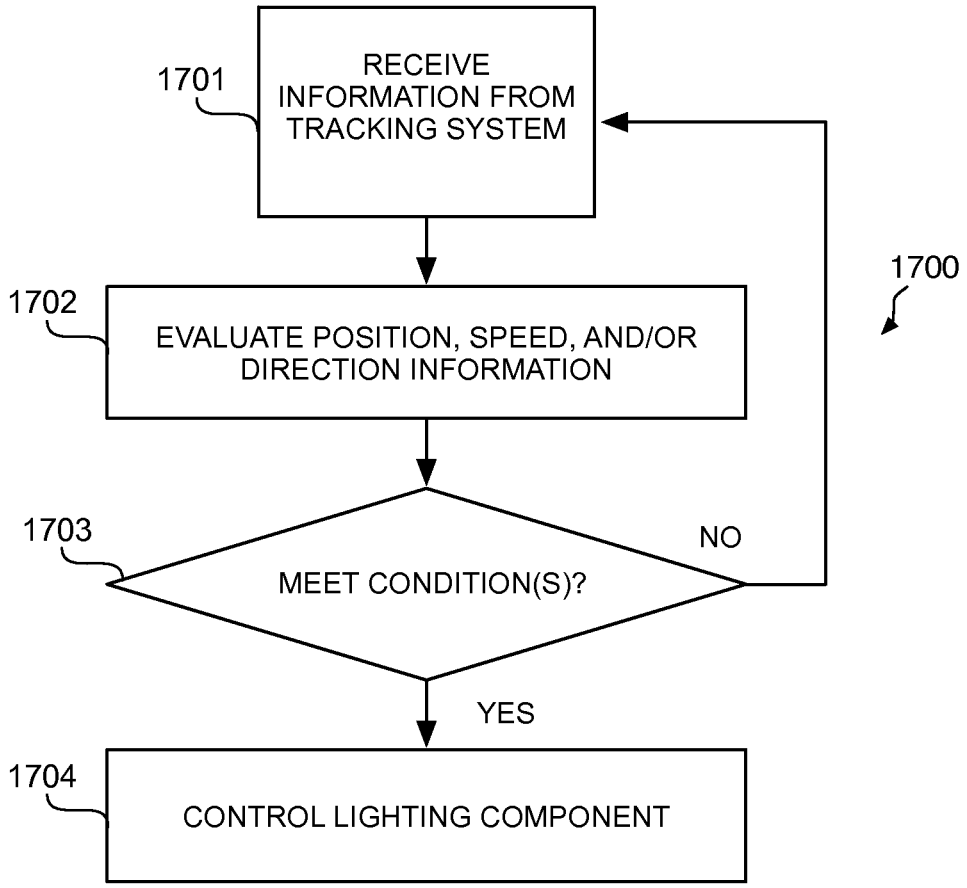
FIG. 17 is a flowchart of an example of a method of operating a lighting component in a pinball machine based on tracking events or information according to some embodiments.

FIG. 17 is a flowchart of an example of a method of operating a lighting component in a pinball machine based on tracking events or information. In some embodiments, method 1700 may be performed, at least in part, by computing system 401 executing software 1300 in cooperation with interface board 402, tracking system 300, and light controller(s) 405. At block 1701, method 1700 may include receiving information from tracking system 300 regarding a physical property (e.g., position, speed, distance, velocity, etc.) of a physical object (e.g., ball 202) within hybrid playfield 104 during a pinball game. At block 1702, method 1700 may include evaluating the tracking information. At block 1703, if the information meets one or more predefined conditions, the light emitted by the controllable lighting component may be modified accordingly. Otherwise, method 1700 returns to block 1701.

To illustrate method 1700, consider the following examples, again, where a controllable lighting component may be used as an actual pinball target. In one implementation, light colors may be changed to provide feedback to the player that the target has been hit (e.g., by ball 202). For instance, when ball 202 is detected to hit or be within a predetermined distance from the target (or moving in the direction of the target), the target's color may be changed. Furthermore, in some cases, the target's appearance may be changed (e.g., in response to ball 202 having hit it or approached it) in the form of a light animation by changing its color and/or brightness over time.

In another implementation, light colors may be used to indicate how many times the target needs to be hit to accomplish specific goals during the game. For example, the color may be set to a dark color (e.g., dark blue), to indicate the player needs to hit the target many times. Each time the target is hit, the color may be changed to something progressively lighter, indicating the target needs to be hit fewer times. When the target is hit a predetermined number of times, the light color may be changed to white, indicating that the target does not need to be hit again. In yet another implementation, light colors may be changed in a first manner when a collision is predicted (e.g., ball 202 is moving in the direction of the target) and in a second manner when an actual collision is detected or in a third manner if the collision is not detected (e.g., the speed of ball 202 was insufficient to reach the target).

It should be noted that the examples described above are a subset of the many ways light colors/intensities may be changed to provide information to onlookers. The exact nature of how the light is changed and what information is being provided based on the colors/intensities can include, but is not limited to, the examples above.

Moreover, it should be understood that the various operations described herein, particularly in connection with FIGS. 15-17, may be implemented in software executed by processing circuitry, hardware, or a combination thereof. The order in which each operation of a given method is performed may be changed, and various elements of the systems illustrated herein may be added, reordered, combined, omitted, modified, etc. It is intended that the invention(s) described herein embrace all such modifications and changes and, accordingly, the above description should be regarded in an illustrative rather than a restrictive sense.

Although the invention(s) is/are described herein with reference to specific embodiments, various modifications and changes can be made without departing from the scope of the present invention(s), as set forth in the claims below. For example, although presented in the context of pinball machines, various systems and methods described herein may be implemented in other types of amusement games. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. In a pinball machine including, at least: a ball, a pinball target located within a playfield, a memory configured to store instructions, and processing circuitry operably coupled to the memory; wherein the pinball machine is configured to provide a pinball game stored in the memory and executed by the processor; wherein the pinball game involves allowing a user to cause the ball to move within the playfield in an attempt to hit the pinball target; a method, comprising:

electronically determining a physical property of the ball, the ball configured to move within the playfield of the pinball machine during the pinball game; and electronically modifying a characteristic of a light emitted by the pinball target within the playfield in response to an evaluation of the physical property, wherein the evaluation is performed by the processor or controller, and wherein the pinball target includes a light emitting element embedded into an acrylic or plastic substrate making the pinball target visually appear to be a monolithic element cast as a single piece.

2. The method of claim 1, wherein the pinball target includes at least one of: a trigger or a barrier.

3. The method of claim 1, wherein the physical property includes at least one of: a speed of the ball over the playfield or a direction of movement of the ball across the playfield.

4. The method of claim 1, wherein the characteristic of the light includes at least one of: color or brightness.

5. The method of claim 1, wherein the evaluation of the physical property includes at least one of: a determination that the speed of the ball matches a predetermined speed over the playfield or a determination that the direction of movement of the ball matches a predetermined direction across the playfield.

6. The method of claim 1, wherein modifying the characteristic of the light includes changing the color or brightness of the light in response to a collision between the ball and the pinball target.

7. The method of claim 1, wherein the characteristic of the light is selected at least in part according to a number of previous collisions between the ball and the pinball target.

8. The method of claim 1, wherein modifying the characteristic of the light includes changing the color or brightness of the light in response to the ball being within a preselected distance of the pinball target, the preselected distance being greater than zero.

9. The method of claim 1, wherein modifying the characteristic of the light includes changing the color or brightness of the light in response to the ball moving in a predetermined direction relative to the pinball target and independently of whether the ball collides with the pinball target.

10. A pinball machine including, at least: a playfield and a pinball target located within the playfield; wherein the pinball machine is configured to allow a user to play a game; the pinball machine further comprising:

a memory configured to store instructions; and processing circuitry operably coupled to the memory, the processing circuitry configured to execute the instructions to cause the pinball machine to make the game available to the user, and, during the game, to:

identify a state or mode of the game played, at least in part, within the playfield of the pinball machine; and control a light emitted by the pinball target located within the playfield in response to the state or mode, wherein the light provides a visual indication of the state or mode, wherein the pinball target includes a light emitting element embedded into an acrylic or plastic substrate, and wherein the pinball target appears to a pinball player to be a monolithic element cast as a single piece.

11. The pinball machine of claim 10, wherein the controlled light instructs a player to hit the pinball target.

12. The pinball machine of claim 10, wherein the controlled light indicates a number of times that the pinball target has previously been hit during the game.

13. The pinball machine of claim 10, wherein the controlled light indicates a number of times that the pinball target has to be hit during the game in order to enter another state or mode.

14. The pinball machine of claim 10, wherein the controlled light instructs a player to avoid hitting the pinball target.

15. The pinball machine of claim 10, wherein controlling the light includes animating the pinball target with a first sequence of color or brightness settings to indicate a first state or mode or animating the pinball target with a second sequence of color or brightness settings to indicate a second state or mode.

16. The pinball machine of claim 10, wherein controlling the light includes changing a multi-pixel image rendered by the pinball target.

17. A pinball machine including, at least: a ball, a pinball target located within a playfield, a memory configured to store instructions, and processing circuitry operably coupled to the memory; wherein the pinball machine is configured to provide a pinball game stored in the memory and executed by the processor; wherein the game involves allowing a user to cause the ball to move within the playfield in an attempt to hit the pinball target; the pinball target further comprising:

an acrylic or plastic substrate configured to receive impact from a ball during a game; and a light element embedded within the acrylic or plastic substrate, wherein the light element is configurable to emit a light having a controllable property, and wherein the light is distributed within the acrylic or plastic substrate to illuminate the entirety of the pinball target.

18. The pinball target of claim 17, wherein the property is selected from the group consisting of: color and brightness.

19. The pinball target of claim 17, wherein the acrylic or plastic substrate includes physical features configured to increase visibility of the light.

20. The pinball target of claim 19, wherein the physical features include holes or bubbles.

* * * * *